United States Patent [19]

Zellmer

[11] 4,434,601

[45] Mar. 6, 1984

[54] HEAT INSULATED ROOF STRUCTURE

[76] Inventor: Hans Zellmer, Ryetvägen 17, Hovås, Sweden, 430 80

[21] Appl. No.: 231,431

[22] Filed: Feb. 4, 1981

[30] Foreign Application Priority Data

Feb. 26, 1980 [SE] Sweden ..... 8001473
Jul. 2, 1980 [SE] Sweden ..... 8004896

[51] Int. Cl.[3] ..... E04G 21/14
[52] U.S. Cl. ..... 52/745; 52/407
[58] Field of Search ..... 52/748, 407, 408, 745

[56] References Cited

U.S. PATENT DOCUMENTS

| | | | |
|---|---|---|---|
| 2,164,138 | 6/1939 | London | 52/407 |
| 2,222,037 | 11/1940 | Lafferty | 52/745 |
| 2,480,330 | 8/1949 | Kump | 52/745 |
| 2,872,882 | 2/1959 | Paul | 52/408 |
| 3,268,999 | 8/1966 | Wiggins | 52/745 |
| 4,047,346 | 9/1977 | Alderman | 52/748 |

FOREIGN PATENT DOCUMENTS

| | | | |
|---|---|---|---|
| 2407308 | 6/1979 | France | 52/408 |

*Primary Examiner*—John E. Murtagh
*Attorney, Agent, or Firm*—Cantor and Lessler

[57] ABSTRACT

A heat insulated roof structure is composed of parallel beams between which a non-combustible, foraminous supporting structure is fitted. The supporting structure may be lengths of wire net, but on occasions glass-fiber fabric may be sufficient. A first layer of heat insulating material rests upon the support structure, the thickness thereof being less than one third of the total insulation thickness. On top of the first insulating layer a diffusion barrier, preferably a sheet of plastics foil, is spread, the sheet having a breadth sufficient to extend un-broken over two adjacent beams. A second layer of heat insulation material is located on top of the barrier, and uppermost there is a watertight sheeting, usually of metal plate. The thicknesses of the two layers of insulation material is selected so a slight compression occurs when the watertight sheeting is fitted, whereby air pockets below the sheeting are avoided.

3 Claims, 12 Drawing Figures

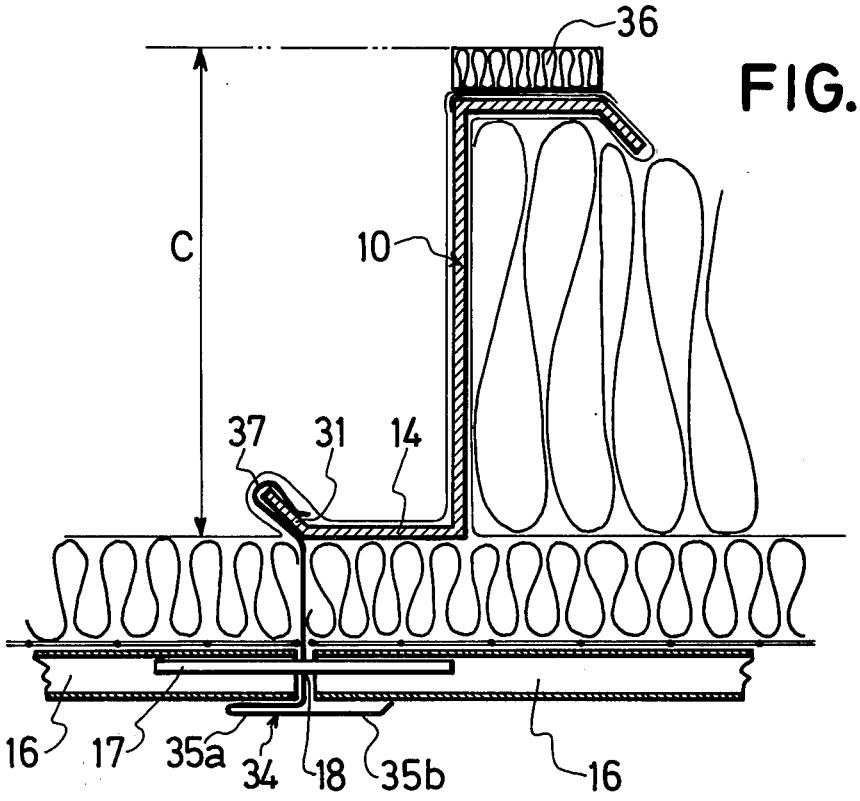
FIG. 8
FIG. 11
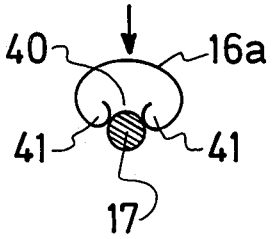
FIG. 12
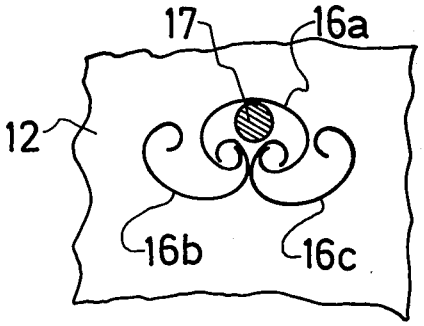

HEAT INSULATED ROOF STRUCTURE

BACKGROUND OF THE INVENTION

The present invention refers to lightweight, heat insulated roof structures, suitable for workshops, indoor arenas and other non-residential buildings.

For many years roof structures have included a carrying structure of plate material, mostly corrugated sheet metal, which were supported by rafters. Heat insulating material was bonded to the plate structure, and on top of the insulating material several layers of watertight, asphalted-felt, or the like, were spread out. Roofs of this type have not been satisfactory, as the watertight covering often cracks due to age incidents of the asphalt material. The covering is futhermore sensitive to workmen walking thereon, as well as to movements and sinkings in the building structure. Temperature changes may cause ruptures, and the fire-spreading capacity of asphalted felt makes the structure unfavourable from a fire resisting point of view.

A further drawback is that the corrugated plate often has to be mounted so the flutes thereof run transversely to the inclination of the roof. Water from leaks, or condensation, will then collect in the flutes, and the damage is often not discovered until the corrosion is destructive.

During later years the asphalt-felt to some extent has been substituted by metal sheeting. Distance members, such as purlins, have been fitted between a lower layer of boards or plates and the metal sheeting to form spaces for insulating material, such as slates of mineral wool. Roofs for workshops and the like often have a rather big span, and it is desirable to locate the primary carrying structures (the rafters) widely apart. It is therefore important, that the roof structure has a low dead weight. Earlier roof designs have had a rather high dead weight, as mineral wool of high density and/or twin, continuous layers of sheet material have been included.

A further embodiment of roof design is the purlin roof. This includes purlins (or light beams), which are located transversely in relation to the rafters. Plate material, usually corrugated sheet metal or metal bands, is fitted with the flutes, or the folds, running parallel to the inclination of the roof. Such a roof will require a minimum of maintenance and is not noticeably influenced by movements in the building. No rational heat insulation of this type of roofs has, however, hitherto been proposed, and it has mostly been used for sheds, where a slight anti-condensing insulation has been satisfactory.

One aim of the present invention is to propose a light roof structure having fine heat insulation properties, which has good fire resistant properties, and has a low dead weight, in which a continuous diffusion barrier effectively prevents the formation of condensate, and where the heat insulation material may be arranged so it forms a noise absorbent.

An other object of the invention is to propose a supporting structure for the insulation, which is easily fitted to match varying demands in insulating thicknesses.

A further object of the invention is to provide a foraminous supporting structure, permitting a lower insulating layer to act as a sound absorbent.

An other object of the invention is to provide means for stabilizing the purlins.

A further object is to arrange the supporting structure so it will act as a safety net for the workmen installing the roof.

Still another object of the invention is to arrange the components so as to make pre-assembling on the ground easier.

SUMMARY OF THE INVENTION

A roof structure according to the invention comprises parallel beams, which carry insulating material covered by a watertight sheeting, preferably metal plate. The beams are preferably arranged as purlins resting upon rafters, but may basically be the rafters, or any other beams forming part of the roof structure.

The invention is characterized in a supporting structure mounted at the beams, a first layer of heat insulating material resting on the supporting structure, a vapour penetration preventing barrier running continuously over and along any pair of adjacent components in said number of parallel beams, and a second layer of heat insulating material between the barrier and the watertight sheeting. The thickness of the first insulating layer is preferably less than $\frac{1}{3}$ of the combined thickness of the first and second layers of insulating material and the combined thickness of the first and the second layer of insulating material, in unmounted position, exceeds the distance between the support structure and the watertight sheeting. The support structure preferably comprises a lattice work of non-combustible material, upon which a layer of foraminous material, such as glass-fiber fabric or metal foil, possibly perforated, is laid out. The support structure may be carried by transverse rod members insertable in holes provided in the web portions of said beams.

The means for mounting the support structure at the beams may include transverse rod members insertable in holes provided in the web portions of the beams. The support structure may be carried by channel members mounted upon the rod members, the channel members having a length corresponding to the distance between the webs of the beams.

When the watertight sheeting and the beams are manufactured from metallic material, and each beam comprises an upper flange carrying a strip of heat insulating, load supporting material, wherein the distance between said supporting structure and said watertight sheeting is less than the thickness of said first and second layers of insulating material before mounting thereof.

The channel member may have a basically circular cross section and is provided with an axially running slot, defined by inturned edge portions, said slot having a breadth less than the diameter of said rod member.

A roof of this type may advantageously be errected by arranging a group of said beams in mutual parallel positions upon rafters laid out upon the flooring to be covered by the roof structure, mounting a support structure comprising a lattice work of noncombustible material between the beams, lifting the entity of rafters, beams and interposed support structure to its proper position in the roof structure, and finishing the heat insulation and the watertight sheeting thereat.

BRIEF DESCRIPTION OF THE DRAWINGS

FIGS. 6–8 show how it is possible to obtain various thicknesses of insulation at the same depth of the beam, FIG. 11 is a cross section of a channel member illustrating how it can be snapped upon the rod member, and FIG. 12 illustrates how it will be possible to augment the strength of the channel structure, by combining two or more channel members.

DESCRIPTION OF SOME PREFERRED EMBODIMENTS

Figure 1:
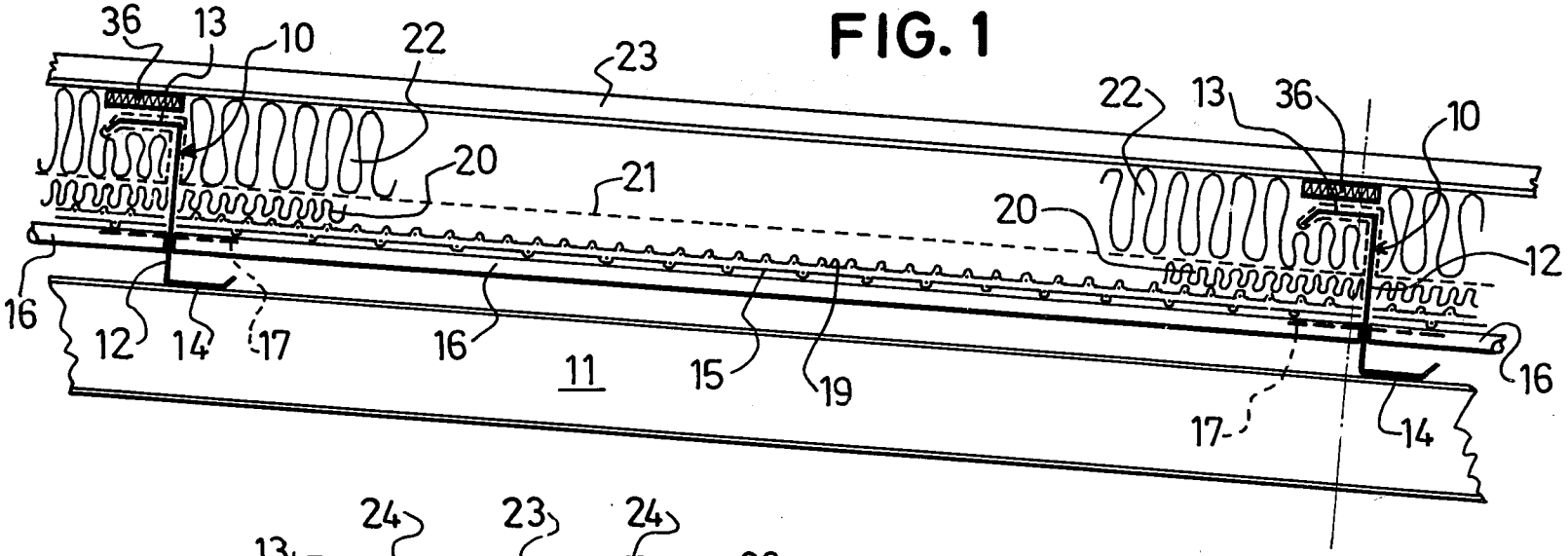
FIG. 1 shows a portion of a roof according to the invention.
Figure 2:
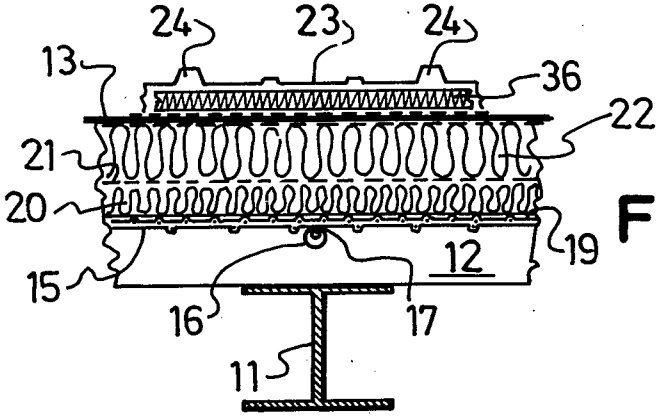
FIG. 2 shows a section along line II—II in FIG. 1.

FIGS. 1 and 2 show a portion of a roof structure comprising parallel purlins resting upon rafters 11. The purlins 10 are to be regarded as examples of the beams mentioned in the claims, and which may have different cross sectional shape, and have differing functions within the structure. With respect to the invention it is only important that they are parallel. The material may be metallic, for instance in the shape of rolled, or flanged profiles, but the beams can also be manufactured of glulam wood, reinforced concrete, or some composite material.

In the embodiments shown the purlins have a Z-shaped cross section, and are made from flanged sheet metal to include a web portion 12, and upper and lower flanges 13 and 14, respectively. A supporting structure is mounted at purlins 10, preferably consisting of pieces of metal wire net, or some other lattice work of spaced apart rods of non-combustible material.

The supporting structure 15 rests upon bars 16, which are mounted upon rod members 17, which are introduced into holes 18 (FIG. 6) in the web portions 12 of the profiles. By means of these holes 18, and the rod members 17 fitted therein, a carrying structure is easily obtained to both sides of a purlin.

Especially when profiles of flanged sheet metal are involved, for instance the Z-profile 10 shown in the drawings, a certain instability of the beams will occur when the spans are extended, as each beam is fastened at its lower flange only. By selecting the lengths of the bars 16 to correspond with the spacing between the beams, it will be possible to obtain a staying of the web portions of the beams a distance above the attachment to the rafters, which will appreciably increase the stability of the roof structure.

The aim of the invention is in the first hand to obtain a satisfactory heat insulation. On many occasions it is also desirable to provide noise dampening, and a general consideration is of course to bring about a fire resistant construction.

Mineral wool has very fine heat insulating properties, and if it is exposed downwardly through the coarse lattice-works 15 a good noise dampening is obtained. The result should, in the first hand, be compared with results obtainable with conventional roofing systems, where the carrying (lowermost) layer consists of corrugated sheet metal, or the like.

On many occasions a direct exposure of the mineral wool is undesirable for the sake of appearance, and it is then possible to spread out a sheet 19 of glassfiber fabric, or perforated aluminium foil, reinforced by glass fibers, or the like, on the supporting structure. A satisfactory noise dampening and a fire resistant construction is still available.

Upon the supporting structure 15, which possibly is covered by a sheet of glass-fiber fabric 19, a first layer 20 of heat insulating material, preferably mineral wool, in slabs or blankets is laid out. With respect to the risk of moist air penetrating into this layer, the thickness thereof is selected so as to be less than one third of the total thickness of insulation material.

A very important feature of the roof structure is the continuous diffusion barrier 21, which is provided above the first insulating layer. Especially when the outermost sheeting consists of metal plate there is an apparent risk that moist air, penetrating from below, will condense upon the metal plate and cause troubles.

It is therefore important, that the diffusion barrier is made continuous, and that it is located at a safe distance from the outermost sheeting. The diffusion barrier 21 can consist of plastics foil, having sufficient breadth to cover the area between two adjacent purlins 10, as well as the upper flanges thereof. Each upper flange will thus be covered by two layers of foil. The foils will have to be arranged so they fit snugly along the upper portions of the webs of the beams, so a following heat insulating layer 22 can extend all the way to the webs. This upper insulating layer preferably also consists of mineral wool.

On top of the heat insulation a water-tight sheeting 23 is fitted, which for reasons above stated often is made of sheet metal, for instance of the type shown in FIG. 2, where the plate is provided with a limited number of corrugations 24.

On the upper flanges 13 of the purlins 10 strips 36 of heat insulating material, having good compression resistant properties are fitted, to prevent direct metal contact between the outer sheeting and the purlins.

The combined thickness of the two insulating layers 20 and 22 is selected so as to be somewhat bigger that the distance between the supporting structure 15 and the upper face of the insulating strips 36, whereby a slight compression of the insulating material occurs when the outer sheeting is mounted. This will prevent the establishing of air pockets directly below the metal sheeting, where condense could occur.

Figure 3:
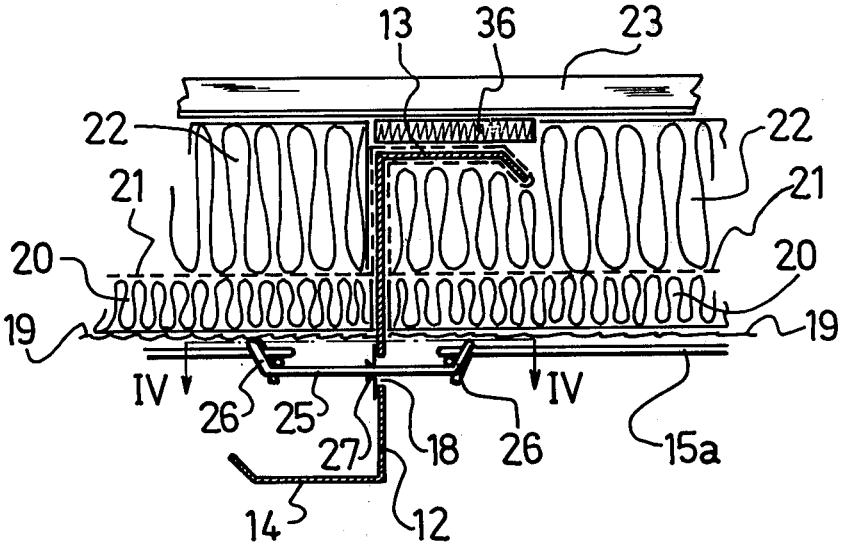
FIG. 3 shows, on a larger scale, a cross section through a beam and components, carried thereby.
Figure 4:
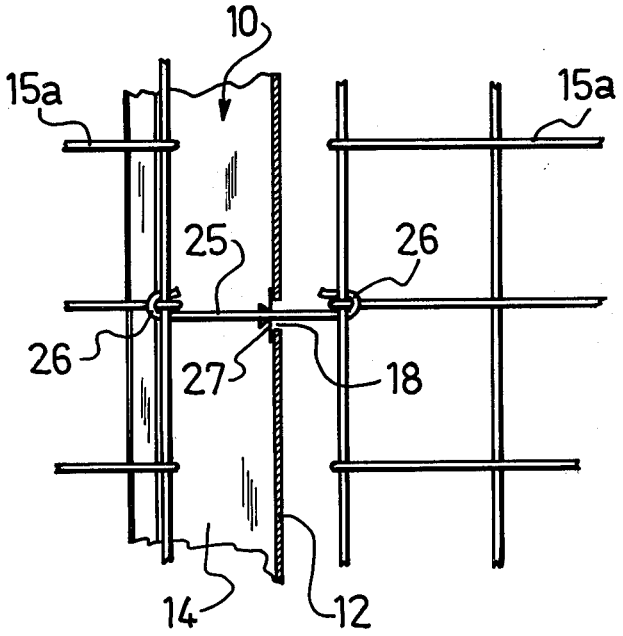
FIG. 4 shows a detail of a section along line IV—IV in FIG. 3.

A favourable design of supporting structure is shown in FIGS. 3 and 4. The Z-shaped purlins 10 are the same as in the previous figures, and their webs are provided with a number of holes 18. Rod members 25 are inserted into these holes, each member being provided with a hook 26 at each end. The rod members 25 are retained in desired positions by means of washers 27. The supporting structure 15*a* is here formed by lengths of wire netting, cut to correspond with the spaces between the purlins 10, and hooked onto the rod members 25.

Advantageously the supporting structure 15*a* is fitted all over the roof, or at a large portion thereof, already as a preliminary step during the erection, as an efficient protective net for the personnel working on the roof will be obtained.

The insulation and the outer sheeting is the same as in the embodiment first described.

Figure 5:
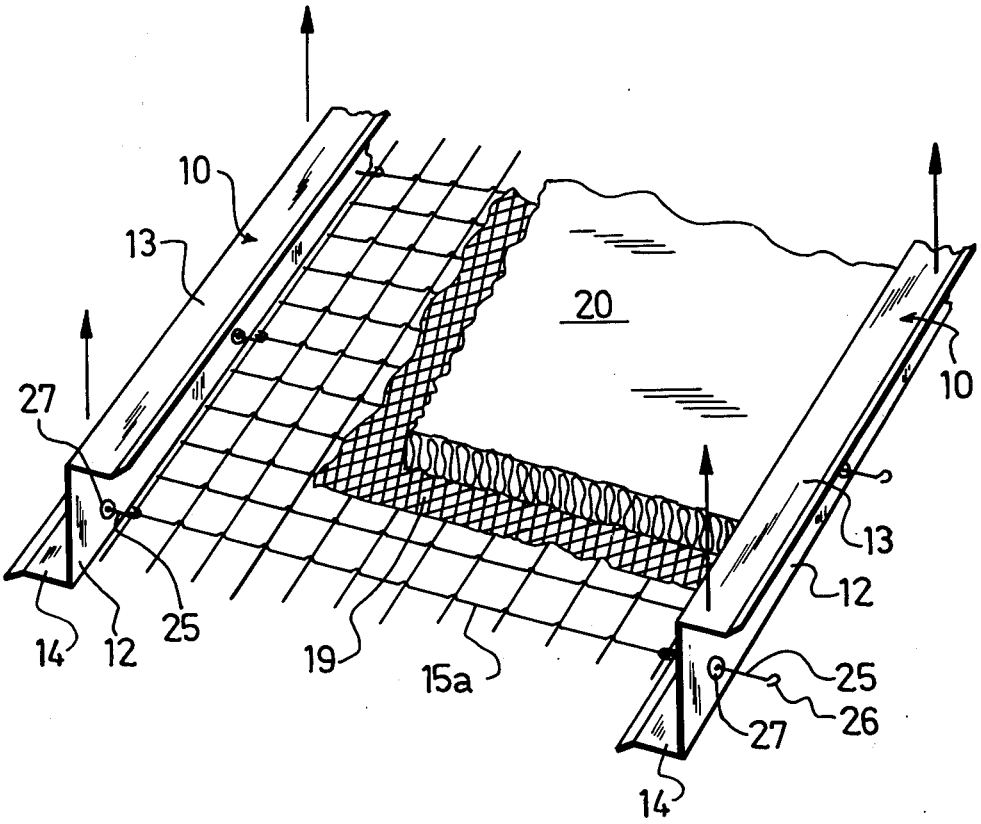
FIG. 5 shows a portion of the roof during preparatory mounting work.

A suitable manner of erecting a roof of this type is schematically illustrated in FIG. 5. A number of rafters for the roof, or for a section thereof, are laid out on the floor of the building. The appropriate number of purlins 10 are then arranged thereon in correct parallel positions, and the supporting structure 15*a* is fitted, whereupon this entity is lifted to its intended position. The length of the roof, the spans of the rafters and the capacity of lifting equipment available will determine how large a section you can handle in this manner. It is of course possible, already on the ground to spread out the glass-fiber sheet 19, the lower, thin insulating layer 20, and possibly also the diffusion barrier 21, as those will not add appreciably to the overall weight.

On many occasions it will not be necessary to have a supporting structure as rigid as the wire net 15*a*, as a strong glass-fiber fabric will be sufficient. The fabric can then be stretched directly upon the bars 16, as in FIG. 1, and will have to be secured at the ends of the field between two adjacent purlins. Pockets for the bars 16 can of course be sewn in the fabric, but that will not often be necessary.

Figure 6:
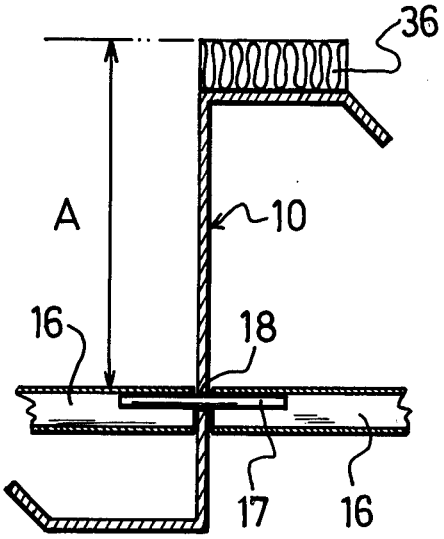
Figure 7:
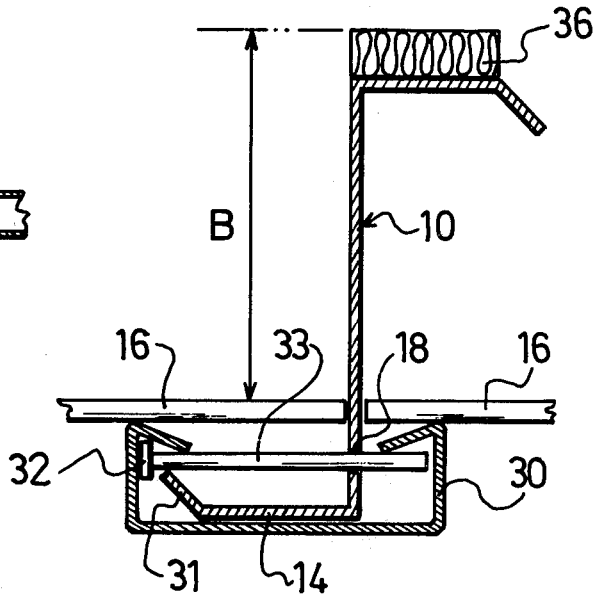

FIGS. 6–8 show different manners of mounting bars 16, so as to obtain different thicknesses of insulation. The embodiment according to FIG. 6 corresponds with that according to FIG. 1, and it is evident that it is possible, within limits, to vary distance A, upwards and downwards by selecting the position of holes 18.

If an extra thick insulation (B) is desirable it is possible to fit a channel member 30 at the lower flange 14 of the purlin 10. The free end of the flange is reinforced by a bent edge portion 31, but manufacturing tolerances are so wide that it is difficult to maintain definite measures. The channel member 30 is therefore broader than flange 14. The holes 18 are located level with edge portion 31 and a rod 33 provided with a head 32 is inserted in each hole 18, and the channel member is fitted thereon.

In case of very thick insulation (C) it is possible to snap a channel member 34 onto the edge portion 31 of the flange, so it will hang below the purlin. The channel member has a basically reversed T-section, with flanges 35*a, b,* which in mounted position are parallel with the lower purlin flange 14, as well as a flanged web portion 37. This is, in part, slanted in the same way as the purlin flange edge portion, and is continued by a vertical portion, in which holes 18 for the rods 16 are arranged. The flanges 35*a,* 35*b* may aid in supporting the bars, and they will cover the joint between the two adjacent fields of insulation.

To simplify the erection it is of course possible to laminate the glass-fiber fabric 19 to the lower insulation 20 (as in FIG. 1) to form a blanket with a breadth corresponding to the distance between the purlins, and with sufficient length to extend in one piece all along the purlins.

Figure 9:
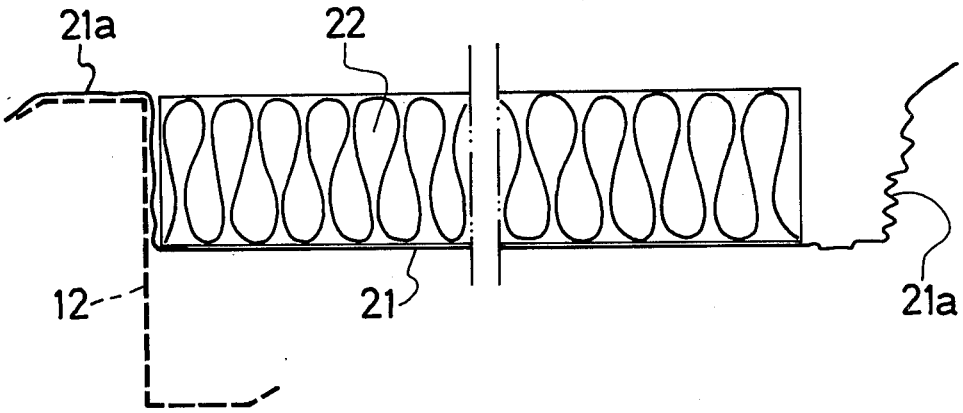
FIG. 9 shows a cross section through the upper insulating layer having the vapour barrier sheet bonded to its lower face.

In the same manner it is possible to laminate the diffusion barrier sheet 21 to the upper, thicker layer 22 of insulation. Care must however be taken to provide sufficient excess material of the barrier sheet 21 along the sides of the insulation. This is schematically illustrated in FIG. 9, where one purlin, 12, is indicated in broken lines. The insulation 22, in slabs or as a blanket has a breadth corresponding to the spacing between the purlins 12, and the barrier sheet 21 is laminated to the lower face of the insulation, and has edge portions 21*a* extending outside the insulation. These edge portions have sufficient breadth to cover the upper flanges of the purlins to form the desired, continuous barrier.

As mentioned earlier it is desirable, that the bars 16 fit snugly between adjacent purlins to stabilize the web portions thereof. In order to facilitate the mounting of the bars 16 they may be formed as channel members 16*a,* having a basically circular cross section—see FIGS. 10–12.

The channel member 16*a* has a longitudinally running slot 40, which is defined by inturned edge portions 41. The breadth of slot 40 is slightly less than the diameter of the rod member 17 to be inserted in the hole 18 in the web of the beam.

Figure 10:
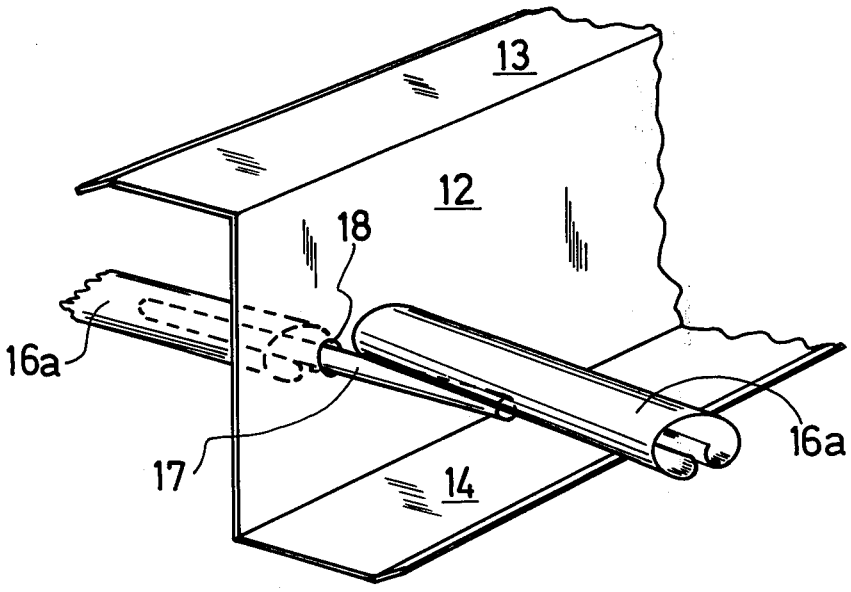
FIG. 10 is a perspective view of a portion with rod and channel members.

FIG. 10 shows a portion of a purlin 12 provided with holes 18 for rod members 17. It will be easy to insert one end of a channel member 16*a* below the top flange 13 of the purlin, pushing it endwise over a rod member 17 there.

As the length of the channel member shall correspond with the spacing between the webs it will not be possible to slip the channel member over the rod 17 at the opposite purlin. It will of course be possible to operate the other way, and bring the channel member to its desired position and to push the rod member from the opposite side of the purlin into the channel member. The channel member 16*a* can, however, be snapped upon the rod as illustrated in FIG. 11. Resiliency of the material will permit the slot 40 to open sufficient to let the rod pass lengthwise into the channel.

This type of supporting bar has a further advantage in that it permits an easy strengthening of the structure, with big spans and/or with very thick insulation. Such arrangement is schematically shown in FIG. 12.

A primary channel member 16*a* is in the manner above described supported by rods 17. A second channel member 16*b* is then snapped into the first channel member 16*a,* whereupon the inturned edge portions interlock. If need be a third channel member 16*c* (shown in broken lines) may then be added.

The embodiments shown and described above must not be regarded in a limiting sense, as many variations are possible within the scope of the appended claims.

What I claim is:

1. A method of erecting a roof structure including a number of parallel beams carrying heat insulating material covered by a watertight sheeting, each beam having a web portion and at least one flange, comprising the steps of:

(a) locating a number of rafters in spaced-apart, parallel relationship upon the flooring to be covered by said roof structure, (b) providing spaced-apart holes in the web portions of said beams, (c) arranging a group of said beams in spaced-apart, parallel relationship upon said rafters perpendicularly thereto and securing them to said rafters, (d) inserting rods in said holes in the webs of said beams, (e) fitting rigid channel members of equal length transversely between any two parallel beams upon said rods, (f) lifting the entity of said rafters, beams and channel members to and incorporating the same in its proper positions in the roof structure, and (g) finishing the heat insulation and the watertight sheeting thereat.

2. The method according to claim 1 further including mounting a support structure comprising a lattice-work of non-combustible material upon said channel members and securing said lattice-work to said roof structure.

3. The method according to claim 1 in which said channel members are given a basically circular cross section, each being provided with an axially running slot defined by inturned edge portions, said slot having a breadth less than the diameter of said rod member.

* * * * *